US005676169A

United States Patent [19]

Landrum

[11] Patent Number: 5,676,169

[45] Date of Patent: Oct. 14, 1997

[54] COUNTERBALANCE VALVE

[75] Inventor: Michael Terrance Landrum, Waseca, Minn.

[73] Assignee: Power Team Division of SPX Corporation, Owatonna, Minn.

[21] Appl. No.: 590,932

[22] Filed: Jan. 24, 1996

[51] Int. Cl.[6] ..... F15B 13/04

[52] U.S. Cl. ..... 137/106; 91/420

[58] Field of Search ..... 91/420; 137/106

[56] References Cited

U.S. PATENT DOCUMENTS

| | | | |
|---|---|---|---|
| 3,817,154 | 6/1974 | Martin | 91/420 |
| 4,006,663 | 2/1977 | Baatrup et al. | 91/420 X |
| 4,172,582 | 10/1979 | Bobnar | 91/420 X |
| 4,244,275 | 1/1981 | Smilges | 91/420 |
| 4,266,464 | 5/1981 | Baatrup et al. | 91/420 X |
| 4,291,718 | 9/1981 | Sanin et al. | 91/420 X |
| 5,400,816 | 3/1995 | Gerstenberger | 91/420 X |

*Primary Examiner*—Gerald A. Michalsky
*Attorney, Agent, or Firm*—Wood, Phillips, VanSanten, Clark & Mortimer

[57] ABSTRACT

The hydraulic counterbalance valve has a valve body with an inlet port, a cylinder port and a pilot port. The valve body has an interior chamber extending through the valve body which forms a check seat where the interior chamber narrows. The interior chamber is in communication with each port by a number of passages. A check valve is disposed in a first passageway between the interior chamber and the inlet port. A bypass passage exists to circumvent the check valve and provide communication between the interior chamber and the inlet port. A control spool is movably disposed in the interior chamber. The control spool has a pilot end, a sealing means, metered groove and a pilot check. The pilot check of the control spool forms a pilot check seal with the check seat of the interior chamber. A spool spring is disposed in the interior chamber and biases the control spool pilot check to seat against the pilot check seat of the interior chamber. The metered groove on the control spool act to permit metered flow from the chamber to the bypass passageway incident to hydraulic pressure at the pilot port sufficient to overcome the force of the spool spring.

9 Claims, 2 Drawing Sheets

COUNTERBALANCE VALVE

BACKGROUND OF THE INVENTION

Technical Field

The present invention is directed toward counterbalance valves, and more particularly towards counterbalance hydraulic valves for controlling hydraulic cylinders that lift, lower and hold a load.

Hydraulic counterbalance valves are old in the art and generally operate in hydraulic systems that develop pressure in the 3,000–10,000 PSI range. The usual function of a counterbalance valve is to control hydraulic flow to and from a hydraulic cylinder that performs work on a load. For example, the work can be lifting a load, and the actions regulated by the hydraulic valve are lifting the load, lowering the load, and balancing the load at a particular position.

In general, counterbalance valves are made up of a valve body having a cavity through which hydraulic fluid flows. A metering spool has a check on one end of the spool that moves in and out of a sealing position in the cavity's hydraulic seat to meter the flow of the hydraulic fluid. This cheek can halt the hydraulic flow when the cheek is seated in the cavity's hydraulic seat. A pilot piston is also disposed in the cavity. This piston moves the metering spool cheek into and out of contact with the hydraulic seat. The cavity is vented between the pilot piston and the hydraulic seat.

The above counterbalance valves may not be reliable for a number of reasons. First, the vent in the cavity between the pilot piston and the metering spool can be an entryway for contaminants to dog the cavity and interfere with the operation of the valve. Specifically, these contaminants could block the vent and cause the hydraulic pressure to build between the pilot piston and the metering spool, thus locking the valve in an open position. These contaminants can also degrade the components of the valve and interfere with the movements of these components or prevent an adequate seal to form at the hydraulic seat. Communication between the pilot piston and the metering spool can easily be interfered with.

Another problem with the structure of the prior art is that the metering spool of the prior art can quickly erode as large amounts of stored hydraulic energy dissipate through this metered opening. Also, the metering spool check that sits in the hydraulic seat of the cavity has a tendency to become unstable and become fully open with very little urging by the pilot piston. This locks the valve in an open position.

The present invention is directed toward overcoming one or more of the problems discussed above.

SUMMARY OF THE INVENTION

In one aspect of the present invention, the hydraulic counterbalance valve comprises a valve body having a bore or interior chamber having an inlet bypass path. The bore is in communication with a first passage. The first passage extends through the bore and communicates with a hydraulic inlet port and a hydraulic cylinder port. Reverse flow prevention means are disposed in the first passage by the inlet port and allow hydraulic pressure to flow from the inlet port to the first passage; but not in the reverse direction. Hydraulic fluid can flow from the inlet bypass path of the bore to the inlet port through a third passage. The hydraulic pilot port is in communication with the bore through a second passage. A control spool is disposed within the bore, and is movable between a first and a second position. The control spool has a seal blocking communication between the first and second passages, and metering means for regulating the hydraulic flow traveling from the first passage to the inlet bypass path. At the end of the control spool is a bypass valve means that allows communication between the inlet bypass path of the bore and the third passage. A control spool spring biases the control spool to the first position. In the first position, the metering means do not allow communication between the first passage and the inlet bypass path and the bypass valve means does not allow communication between the inlet bypass path and the third passage. When the hydraulic pressure from the pilot port overrides the control spool spring's urging, the control spool moves to the second position. In the second position the metering means allow hydraulic flow to pass from the first passage to the inlet bypass path, and the bypass valve allows this flow to travel from the inlet bypass path to the third passage and out of the valve body. In another aspect of the invention the third passage is in communication with the inlet bypass path of the bore and the inlet port.

In another aspect of this invention the reverse flow prevention means is a one-way valve comprising a check seat disposed in the inlet port. The check seat is sealed to the inlet port by a seal means and has a check ball positionable in the check seat to form a seal and prevent reverse flow from the first passage into the inlet port.

In another aspect of this invention, the metering means is an opening integral to in the control spool comprising a gradual opening whereby the flow rate of the hydraulic fluid travelling to the inlet bypass path from the first passage gradually increases as the control spool moves to the second position.

In another aspect of this invention the bypass valve means comprises a pilot check lip on the control spool next to the control spool spring, whereby the force of the spring is greater than the force of the pressure at the pilot port, causing the pilot check lip to form a seal with the pilot check seat of the bore and prevent hydraulic flow from the inlet bypass path section of the bore to the third passage.

In another aspect of the invention, a hydraulic counterbalance valve comprises a valve body with a bore defining an interior chamber, an inlet port, a cylinder port, a pilot port, and first, second and third passageways. The first passageway extends from the inlet port to the cylinder port and opens into the interior chamber. The second passageway extends from the pilot port to the interior chamber, and the third passageway extends from the interior chamber to the inlet port. A check valve is disposed in the first passageway between the inlet port and the interior chamber. The check valve permits flow from the inlet port to the cylinder port but not from the cylinder port to the inlet port through the first passageway. A control spool movably received in the interior chamber has a pilot end near the second passageway, seal means for sealing the spool in the chamber between the pilot port and the first and third passageways, and an integral bypass valve engageable with a bypass valve seat in the bore selectively controlling the flow from the interior chamber to the third passageway. A spool spring urges the spool in a direction so that the bypass valve engages the bypass valve seat. Metering means are operatively associated with the spool in the interior chamber between the first passageway and the third passageway. This flow is allowed when hydraulic pressure at the pilot port is sufficient to overcome the force of the spool spring to provide control flow from the cylinder port to the inlet port.

It is an object of the invention to provide a counterbalance hydraulic valve in which the metering spool and pilot piston are a part of the same structure.

It is a further object of this invention to provide a hydraulic counterbalance valve wherein the metering spool seat is separated from the metering means.

DESCRIPTION OF THE PREFERRED EMBODIMENT

Figures 1, 2:
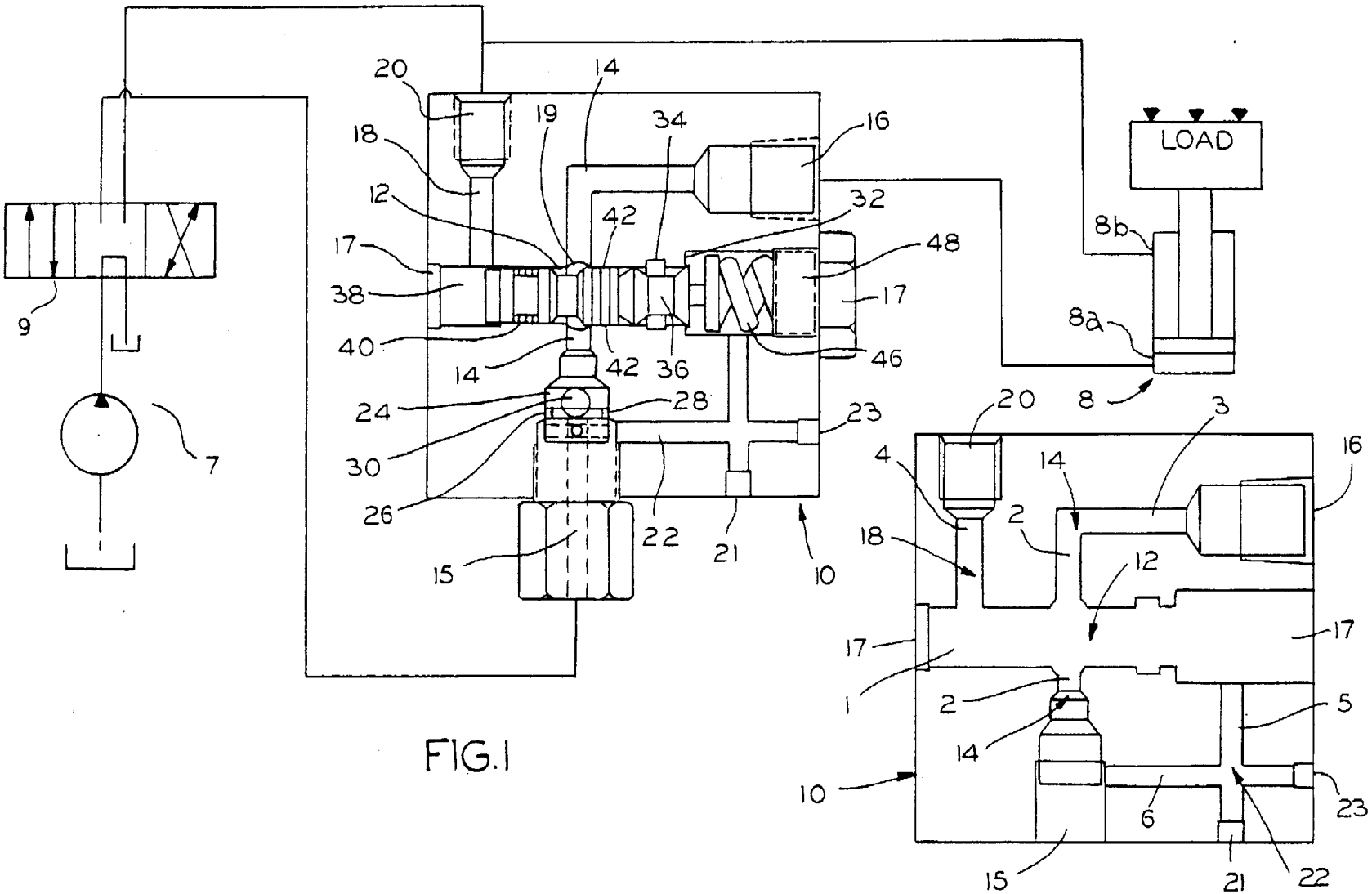
FIG. 1 is a hydraulic schematic including a sectional view of a counterbalance valve according to the invention view of the preferred embodiment.
FIG. 2 shows the layout of the bores in the valve body of the preferred embodiment.

FIG. 1 shows a hydraulic schematic drawing of a hydraulic system including a pump, a directional valve, a counterbalance valve according to the invention and a hydraulic cylinder. The pump 7 directs hydraulic flow from a tank through a directional valve 9 and a counterbalance valve 10 to a hydraulic cylinder 8. The hydraulic cylinder 8 raises, holds and lowers a load, depending on the directional valve 9 setting. The valve 10 controls the flow of pressure from the directional valve 9 and the hydraulic cylinder 8.

As shown in FIG. 2, the valve body 10 has a first bore 1 of varying diameter extending from one end of the valve body 10 to the other. This bore forms an interior chamber 12 of the valve body. A second bore 2 extends through the valve body 10 perpendicular to the first bore 1. This second bore 2 does not extend through the entire valve body but rather ends after extending through the first bore. The second bore 2 intersects a third bore 3 which extends in the valve body 10 parallel to the first bore 1 and perpendicular to the second bore 2. A fourth bore 4 is parallel to the second bore 2 and intersects the first bore 1, yet does not intersect the third bore 3. The fourth bore 4 extends from the side of the valve body 10 opposite the second bore 2.

A fifth bore 5 is in communication with and perpendicular to the first bore, and is parallel to the second bore 2. This fifth bore 5 is disposed in the valve body 10 within the 90° angle formed by second and third bores 2 and 3. A sixth bore 6 is also disposed within the 90° angle of the second and third bores 2 and 3, and perpendicularly intersects the fifth bore 5 and the second bore 2. The sixth bore 6 begins at the valve body 10 wall, extends perpendicularly through the fifth bore 5 and ends at the second bore 2. Thus the interior chamber 12 can communicate with the second bore 2 through the fifth and sixth bores 5 and 6.

The second and third bores 2 and 3 are in communication with each other and form a first passage 14. The first passage 14 has an inlet port 15 where the second bore 2 meets a valve body 10 wall and a hydraulic cylinder port 16 where the third bore 3 meets a valve body 10 wall. The intersection of the first passage 14 and the interior chamber 12 forms and enlarged junction 19 in the interior chamber 12. The fourth bore 4 acts as a second passage 18 and connects to a hydraulic pilot port 20 at the wall of the valve body 10 and extends to communicate with the interior chamber 12.

The fifth and sixth bores form a third passage 22 and are plugged at 21 and 23 where they meet the valve body wall. The third passage 22 allows communication between the interior chamber 12 and the inlet port 15.

Figure 3:
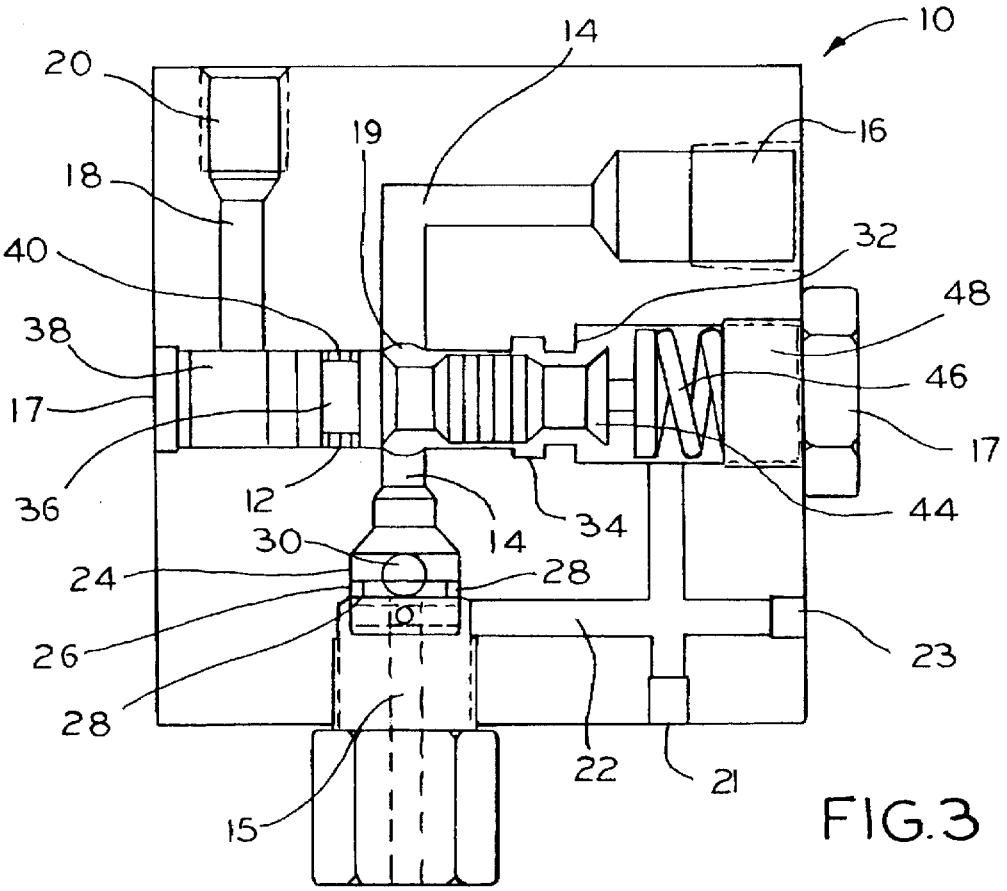
FIG. 3 shows the valve of FIG. 1 when the control spool is in a second position.

As shown in FIGS. 1 and 3, a check valve 24 is disposed in the inlet port 15 between the first passage 14 and the third passage 22. The check valve 24 prevents reverse flow of hydraulic fluid from the first passage 14 into the inlet port 15. This check valve 24 consists of a check seal 26, a bypass check seat 28 and a check ball 30. When hydraulic flow proceeds from the inlet port 15 to the first passage 14 the check ball 30 does not seat in the check seat 28 and the hydraulic flow travels around the ball 30 to the first passage 14. However, when the hydraulic flow comes from the first passage 14 to the inlet port 15, the pressure causes the ball 30 to form a seal in the check seat 28, thus preventing hydraulic flow from travelling from the first passage 14 to the inlet port 15.

The interior chamber 12 is closed off at both ends by plugs 17. The interior chamber 12 has an enlarged diameter for a portion of the chamber 12 that is disposed in the area of the intersection of the third passage 22 and the interior chamber 12. This enlarged portion is situated at one end of the interior chamber 12, and narrows in diameter to form a pilot check seat 32. Between this seat 32 and the junction 19, the interior chamber 12 again briefly widens in diameter to form an inlet bypass path 34. At the junction 19, the interior chamber 24 has an enlarged diameter.

A control spool 36 is disposed in the interior chamber 12. The control spool 36 has a pilot end 38 disposed in the interior chamber 12 proximate the second passage 18. An O-ring type seal 40 is disposed on the control spool 36 next to the pilot end 38 and between the second passage 18 and the first passage 14 to seal the control spool 36 in the chamber 12, thereby preventing communication between the first 14 and second 18 passages. The control spool 36 also has metering grooves 42 disposed on the control spool 36 between the first passage 14 and the inlet bypass path 34. These metering grooves 42 are longitudinally extending grooves on the exterior of the control spool 36 that are tapered at the end closest to the inlet bypass path 34. At the other end of the control spool 36 is a pilot check 44 which has an enlarged diameter and seats in the pilot check seat 32 of the interior chamber.

Figure 4:
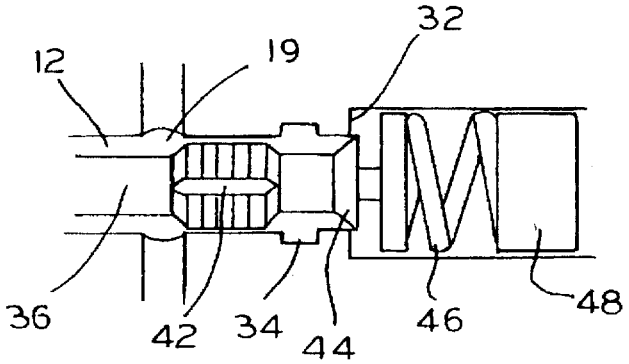
FIG. 4 is a partial top view of the valve with the control spool in a first position.
Figure 5:
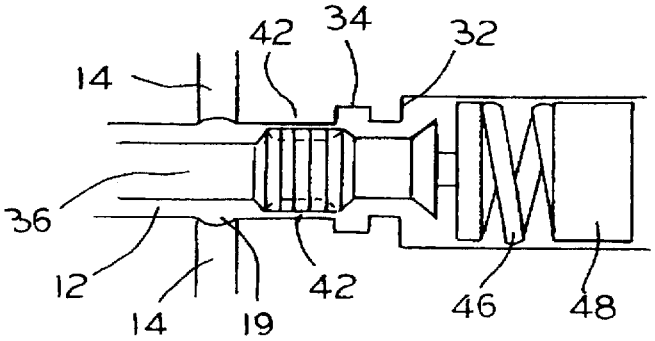
FIG. 5 is a partial side view of the valve with the control spool in the second position.

The control spool 36 is slidable between two positions. FIGS. 1 and 4 show the control spool 36 in the first position, and FIGS. 3 and 5 slow the control spool 36 in the second position. In the first position the pilot check 44 is seated in the pilot check seat 32 and the metering grooves 42 do not communicate with the inlet bypass path 34. In the second position, the control spool 36 slides away from the second passage 18 such that the pilot check 44 no longer forms a seal with the pilot check seat 32, and the metering grooves 42 are in communication with both the first passage 14 and the inlet bypass path 34. The construction of the valve body 10 is such that when the control spool 36 is in the second position, hydraulic flow can travel from the first passage 14, through the metering grooves 42 into the inlet bypass path 34, past the pilot check seat 32, through the third passage 22, and into the inlet port 15 without traveling across the check valve 24.

Adjacent the pilot check 44 of the control spool 36 is a control spool spring 46 which is anchored by a control spool spring retainer 48. The control spool spring 46 biases the control spool 36 toward the first position.

The operation of the preferred embodiment will now be discussed. Lifting of a load is achieved when the directional valve 9 directs fluid from the pump 7 to the inlet port 15 of the valve body 10. Hydraulic flow travels past the reverse flow prevention means, or check valve 24 into the first passage 14, and through the junction 19 region of the interior chamber 12. Seal 40 prevents hydraulic flow from travelling to the second passage 18, and the control spool spring 46 is biasing the control spool 36 in the first position, so the metering means, or metering grooves 42, prevent flow to the third passage 22. The hydraulic flow then travels through the first passage 14 and out of the valve body 10 through the hydraulic cylinder port 16 to the base port 8*a* of the cylinder 8 causing pressure in the cylinder to increase, thus lifting the load.

The holding mode is achieved when the directional valve 9 is set in the holding setting, which prevents hydraulic from entering or leaving the system. The load of the hydraulic cylinder forces hydraulic through the base port 8*a* to the hydraulic cylinder port 16. The reverse flow from the hydraulic cylinder port 16 is stopped by the reverse flow prevention means 24. Because insufficient pilot pressure exists at the pilot port 20 to urge the spool 36 from the first position, the metering means 42 do not allow this flow from the cylinder port 16 to flow into the inlet bypass path 34. The seal 40 prevents flow from the cylinder port 16 to the pilot port 20. Thus, this hydraulic flow from the cylinder base port 8*a* does not dissipate, and the load is held at a desired level.

The lowering mode is achieved when the directional valve 9 is switched to the lowering setting. The lowering setting allows the pump 7 to direct pressure to the pilot port 20. At this, pilot pressure travels from the pump 7 to the pilot port 20 and builds in the interior chamber 12, causing the control spool 36 to move from the first to the second position. There is also a large amount of pressure in the first passage 14 from the hydraulic cylinder 8, which the hydraulic cylinder 8 releases as it lowers. When the metering grooves 42 communicate with the inlet bypass path 34, this built up hydraulic pressure can escape. The metering grooves 42 are tapered to allow a controlled, gradual dissipation of this hydraulic pressure, and a controlled lowering of the load.

When enough pressure from the pilot port 20 exists to overcome the urging of the control spool spring 46, the control spool 36 will leave the pilot check seat 32. Due to the tapered nature of the metered grooves 42, only a small amount of hydraulic flow will travel through the metering grooves 42 to the inlet bypass path 34, past the control spool pilot check 44, thus preventing heat build-up and erosion of the pilot check seat 32. As the hydraulic pressure continues to build, control spool 36 will continue to move toward the control spool spring 46, and the control spool metering grooves 42 further open access to the inlet bypass path 34. When the control spool 36 is in the second position, hydraulic flow from the cylinder is allowed to dissipate through the valve body 10, thus allowing the load to begin to lower.

This flow ram will increase until the flow rate of the pump 7 is reached in the red end cylinder port 8*b*, at which point pressure in the pilot port 20 will cease to increase. As the load forces more flow through the valve body 10 than can be supplied by the pump 7, the pressure in the pilot port 20 will decrease, thus allowing the control spool spring 46 to push the control spool 36 to the first position. The metering grooves 42 will slide away from the inlet bypass path 34, thus closing access to the third passage 22, and preventing the hydraulic flow through the valve 10.

In this way the valve 10 controls the lowering of the load to match the flow rate from the pump 6 entering the cylinder 8. As the load is lowered, all the heat energy is dissipated by the control spool metering grooves 42 in conjunction with the inlet bypass path 34, and not the pilot check seat 32. This protects the pilot check seat 32 from erosion, thus giving the valve 10 a longer, more reliable life.

This design incorporates no small orifices or vents which can act as entry ways for contaminants. Further, this hydraulic counterbalance valve is designed so that nothing other than pilot pressure has influence on movement of the control spool and thus the hydraulic cylinder. This results in a more responsive control system.

Because the metering means 42, pilot check 44 and pilot portion 38 are located on a single spool, this valve offers users a more responsive control mechanism then prior art. Further, because the metering means 42 and the pilot check 44 are separated, less wear and heat due to erosion during pressure dissipation will occur. This gives the valve a longer life and makes the valve more reliable than the prior art.

Still other aspects, objects, and advantages of the present invention can be obtained from a study of the specification, the drawings, and the appended claims.

I claim:

1. A counterbalance hydraulic valve comprising:

a valve body having a bore extending through the valve body, the bore having an inlet-bypass path;

a first passage in communication with the bore and extending through the bore;

a hydraulic inlet port in communication with the bore through the first passage;

a hydraulic cylinder port in communication with the bore through the first passage;

a second passage in communication with the bore; a hydraulic pilot port in communication with the bore through the second passage;

a third passage which can be in communication with the inlet-bypass path of the bore and the inlet port, the hydraulic inlet port having a reverse flow prevention means hydraulically positioned between the first passage and the third passage;

a control spool disposed in the bore, and movable between a first position, which prevents communication between the first and third passages, and a second position, in which communication between the first and third passages occurs, the control spool comprising a seal, positioned on the control spool and disposed between the intersection of the first and second passages with the bore, blocking communication between the first and second passages, metering means on the spool for regulating the hydraulic flow travelling from the first passage through the inlet-bypass path to the third passage, when the control spool shifts to the second position, a bypass valve means on the control spool that, when the spool is in the second position, allows communication between the inlet-bypass path of the bore and the third passage, and does not allow communication between the inlet-bypass path and the third passage when the spool is in the first position; and a control spool spring biasing the control spool into the first position, the control spool spring acting in opposition to the hydraulic flow pressure applied at the pilot port, which pressure urges the control spool towards the second position.

2. The counterbalance hydraulic valve of claim 1 wherein the third passage is in communication with the inlet port such that when the control spool is in the second position, the hydraulic flow from the first passage passes through the metering means into the inlet-bypass-path to the third passage and into the inlet port.

3. The counterbalance hydraulic valve of claim 1 wherein the reverse flow prevention means comprises a one-way valve.

4. The counterbalance hydraulic valve of claim 3 wherein the one-way valve comprises a check seat disposed in the inlet port;

a check ball, positionable in the check seat to form a seal with the check seat;

a seal means for sealing the check seat in the inlet port, whereby a hydraulic flow travels from the first passage to the one way valve, the check ball seals in the sealed check seat to prevent first passage hydraulic flow from entering the bore.

5. The counterbalance hydraulic valve of claim 1 wherein the metering means comprises an opening in the control spool and allows communication between the first passage and the inlet bypass path section of the bore when the control spool is in the second position.

6. The counterbalance hydraulic valve of claim 5 wherein the opening comprises a gradual opening whereby the flow rate of the hydraulic travelling to the inlet bypass path section from the first passage is zero when the control spool is in the first position and as the control spool moves to the second position the flow rate gradually increases.

7. The counterbalance hydraulic valve of claim 6 wherein the gradual opening is a longitudinal tapered groove extending along the surface of the control spool.

8. The counterbalance hydraulic valve of claim 1 wherein the bypass valve means comprises:

a pilot check lip on the control spool proximate the control spool spring, whereby when the force of the spring is greater than the force of the pressure at the pilot port, the control spool pilot check lip forms a seal with a pilot check seat of the bore, preventing hydraulic flow from the inlet-bypass path section of the bore to the third passage.

9. A hydraulic counterbalance valve comprising:

a valve body having a bore defining an interior chamber, an inlet port, a cylinder port and a pilot port, a first passageway extending from said inlet port to said cylinder port and opening into said interior chamber, a second passageway extending from said pilot port to said interior chamber and a third passageway extending from said interior chamber to said inlet port;

a check valve disposed in said first passageway between said inlet port and said interior chamber, said check valve permitting flow from the inlet port to the cylinder port, but not from said cylinder port to said inlet port through said first passageway;

a control spool movably received in said interior chamber, said spool having a pilot end proximate the second passageway, seal means for sealing the spool in the chamber between said pilot port and the first and third passageways, and an integral bypass valve engageable with a bypass valve seat in said bore selectively controlling flow from said interior chamber to said third passageway;

a spool spring urging said spool in a direction so that the bypass valve engages the bypass valve seat; and metering means operatively associated with the spool and the interior chamber between said first passageway and said third passageway to permit metered flow from the chamber to the third passageway incident to hydraulic pressure at the pilot port sufficient to overcome force of the spool spring to provide controlled flow from the cylinder port to the inlet port.

* * * * *